US005780190A

United States Patent [19]

Listigovers et al.

[11] Patent Number: 5,780,190

[45] **Date of Patent: *Jul. 14, 1998**

[54] MAGNETIC IMAGE CHARACTER RECOGNITION PROCESSES WITH ENCAPSULATED TONERS

[75] Inventors: Nancy A. Listigovers, Oakville; Richard P. N. Veregin; Fernando P. Yulo, both of Mississauga; Kayong Koch, Scarborough, all of Canada

[73] Assignee: Xerox Corporation, Stamford, Conn.

[ * ] Notice: The portion of the term of this patent subsequent to Feb. 28, 2011, has been disclaimed.

[21] Appl. No.: 445,221

[22] Filed: Dec. 4, 1989

[51] Int. Cl.[6] ..... G03G 19/00

[52] U.S. Cl. ..... 430/39; 430/126.6; 430/111; 430/138

[58] Field of Search ..... 430/138, 109, 430/137, 106.6, 39

[56] References Cited

U.S. PATENT DOCUMENTS

| | | | |
|---|---|---|---|
| 3,627,682 | 12/1971 | Hall et al. | 252/62.54 |
| 4,016,099 | 4/1977 | Wellman et al. | 252/316 |
| 4,265,994 | 5/1981 | Hasegawa et al. | 430/107 |
| 4,268,598 | 5/1981 | Leseman et al. | 430/107 |
| 4,339,518 | 7/1982 | Okamura et al. | 430/126 |
| 4,439,510 | 3/1984 | McLoughlin | 430/137 |
| 4,497,885 | 2/1985 | Ushiyama et al. | 430/106.6 |
| 4,503,086 | 3/1985 | Knapp et al. | 355/14 D |
| 4,517,268 | 5/1985 | Gruber et al. | 430/39 |
| 4,520,091 | 5/1985 | Kakimi et al. | 430/110 |
| 4,536,462 | 8/1985 | Mehl | 430/106 |
| 4,563,086 | 1/1986 | Knapp et al. | 355/14 D |
| 4,581,312 | 4/1986 | Nakahara et al. | 430/102 |
| 4,590,142 | 5/1986 | Yamazaki et al. | 430/138 |
| 4,599,289 | 7/1986 | Suematsu et al. | 430/98 |
| 4,642,281 | 2/1987 | Kakimi et al. | 430/138 |
| 4,758,506 | 7/1988 | Lok et al. | 430/903 |
| 4,803,144 | 2/1989 | Hosoi | 430/106.6 |
| 4,877,706 | 10/1989 | Mahabadi et al. | 430/110 |
| 4,877,707 | 10/1989 | Grushkin et al. | 430/110 |
| 5,034,298 | 7/1991 | Berkes et al. | 430/110 |

FOREIGN PATENT DOCUMENTS

| | | | |
|---|---|---|---|
| 3305371 | 12/1988 | Japan | 430/138 |

*Primary Examiner*—Roland Martin
*Attorney, Agent, or Firm*—E. O. Palazzo

[57] ABSTRACT

An ionographic process which comprises the generation of a latent image comprised of characters; developing the image with an encapsulated magnetic toner comprised of a core comprised of a polymer and magnetite and wherein the core is encapsulated within a polymeric shell; and subsequently providing the developed image with magnetic ink characters thereon to a reader/sorter device.

39 Claims, No Drawings

MAGNETIC IMAGE CHARACTER RECOGNITION PROCESSES WITH ENCAPSULATED TONERS

BACKGROUND OF THE INVENTION

The present invention is generally directed to imaging processes with toner and developer compositions, and more specifically the present invention is directed to imaging and printing processes with encapsulated toner compositions, particularly processes for generating documents such as personal checks which are subsequently processed in reader/sorters. In one embodiment of the present invention, there are provided processes for generating documents, such as checks, including for example dividend checks, turn around documents such as invoice statements, like those submitted to customers by American Express® and VISA®, corporate checks, highway tickets, rebate checks, utility bills, credit card invoices, other documents with magnetic codes thereon, and the like, with encapsulated toners. More specifically, in one embodiment the process of the present invention is accomplished with encapsulated toners containing in the core thereof magnetites, especially magnetites with low remanence of from about 20 to about 70 Gauss, and preferably from about 25 to about 55 Gauss. The magnetites are preferably contained in a low glass transition temperature of from, for example, about −100° C. to about −10° C., and preferably from about −70 to about −25° C., and more preferably about −50° C., non-brittle polymer. The aforementioned core of polymer and magnetite is encapsulated in a polymeric shell. With the encapsulated toners of the present invention, image smearing and offsetting of the toner to read and write heads, including offsetting to the protective foil that may be present on the aforesaid heads in magnetic ink character recognition processes and apparatus inclusive of, for example, the read and write heads present in MICR (magnetic ink character recognition) reader/sorters such as the commercially available IBM 3890™, NCR 6780™, reader/sorters from Burroughs Corporation, and the like are avoided or minimized. Some of the reader/sorters contain protective foils thereon, reference for example the IBM 3890™, and the problems associated with such protective foils as illustrated herein with respect to read and write heads with no foils are alleviated or minimized with the processes of the present invention. Accordingly, with the processes utilizing the toner compositions illustrated herein the problems of image smearing to, and offsetting from the read and write heads in magnetic ink character recognition apparatuses is substantially eliminated. Moreover, in another embodiment the present invention is directed to improved economical processes for generating documents such as personal checks suitable for magnetic image character recognition wherein image smearing and toner offsetting, including offsetting to read and/or write heads including those with protective foils thereon, or unprotected heads as indicated herein is avoided when such documents are processed in the aforementioned reader/sorters. The toner compositions selected for the process of the present invention in an embodiment are comprised of a core of a polymer and certain magnetites, which core is encapsulated in a polymeric shell, and wherein the shell can be generated by interfacial polymerization. Examples of the aforementioned toners are illustrated in U.S. Pat. No. 4,877,706, the disclosure of which is totally incorporated herein by reference. The processes of the present invention are particularly useful with magnetic single component inductive development, such as those employed in the Delphax S6000™ or Xerox Corporation 4060™ ionographic printers. Further, the processes of the present invention enable in an embodiment thereof surface electroconductivity which does not change under vigorous agitation, and is in the range of about $10^{-4}$ to about $10^{-8}$ $ohm^{-1}$ $cm^{-1}$, and preferably in the range of about $10^{-5}$ to about $10^{-7}$ $ohm^{31\ 1}$ $cm^{31\ 1}$, and output copy quality free of background and deletions. In addition, the processes of the present invention are useful in imaging systems wherein pressure fixing, especially fixing in the absence of heat, can be utilized, and electrophotographic, including xerographic, imaging processes. Cold pressure fixing processes have a number of advantages in comparison to heat fixing, primarily relating to the requirements for less energy.

Toner offset is eliminated or minimized with the processes of the present invention in one embodiment. Offset results from, for example, the developed toner image being removed from the MICR (magnetic ink character recognition) document, such as a check, to the read and/or write heads and/or protective foil contained in MICR readers such as the IBM 38907™ and the NCR 6780™. When the aforesaid offset is eliminated or substantially reduced, the problem of image smearing onto the MICR documents, such as personal checks, is also avoided or minimized. By offset is meant, for example, that the toner is released from the document, such as personal checks, and transfers and sticks to the aforementioned read and/or write heads. As a result, toner is removed from the checks, or other documents as illustrated herein primarily in a continuous manner causing image smearing, and substantially preventing the characters on the checks from being read magnetically and thus rejected in most instances. With the processes of the present invention, image offset to protective foils as are contained in some reader sorters, for example the IBM 3890™, is greatly reduced, for example, by as much as a factor of 10, or eliminated. A reduction in image smearing and offset to the protective foils is known to lead to a reduction in the rejection rate. With the process of the present invention in an embodiment thereof, a reject rate of less than one half of 1 percent is expected, it being noted that the acceptable reject rate usually does not exceed one half of 1 percent (0.5 percent) as determined by the American National Standards Institute (ANSI). Typically, the reject rate with the process of the present invention is expected to be from about 0.05 to about 0.3 percent depending, for example, on the sorter set up conditions as contrasted to a reject rate in excess of one half of 1 percent, which is not acceptable. Also, with toner build up on the read/write heads, the excess toner is released to the check document being processed causing image smearing, which prior art disadvantage is avoided or minimized with the processes of the present invention.

With further respect to the present invention, the process is applicable in an embodiment to the generation of documents including personal checks, which have been fused with pressure roll fusers. Pressure fixing systems such as that incorporated into the commercial Xerox Corporation 4060™ machine, and the commercial Delphax S6000™ ionographic printer are particularly useful with the processes of the present invention. In addition, fusing systems where heat is used in combination with pressure, for example where the above mentioned printers have been modified, are also applicable. Fuser roll temperatures of about 120° C. to about 180° C., and preferably from about 140° C. to about 165° C., are suitable.

Documents, including the personal checks mentioned herein, can be obtained, for example, by generating a latent image thereon and subsequently developing the image, reference U.S. Pat. No. 4,517,268 and Japanese 60073630, the disclosures of which are totally incorporated herein by reference, with the encapsulated toner compositions illustrated herein. The developed image that has been created, for example, in the Xerox Corporation 4060™ printer contains thereon, for example, the characters zero, 1, 2, 3, 4, 5, 6, 7, 8, and 9 and up to four symbols (E-13B and CMC-7 font), which characters are magnetically readable by the IBM 3890™, or other similar apparatus. One of the problems avoided with the processes of the present invention is to eliminate or reduce the offsetting of the toner as indicated herein to the read and write heads and/or protective foil in the apparatus selected for this purpose such as the IBM 3890™.

Conventional toners with thermoplastic resins can be selected as the material to fuse the image to paper. These materials are brittle at room temperature and are susceptible to flaking off the paper particularly when creased. Flaking of the toner by the read head is a common problem for magnetic image character recognition (MICR) images. The processes of the present invention avoid this problem by, for example, the use of a low glass transition temperature polymer which is flexible at room temperature enabling, for example, excellent crease. Also, as encapsulated toners selected for the processes of the present invention fuse under pressure, the pile height of the toner on the paper is lower than that obtained by heat fusing alone, thereby assisting in reducing the toner flaking off the paper. In comparison to conventional toner images which are fused to paper using heat, the pressure fused images of the present invention in one embodiment are smooth and glossy, and consequently less susceptible to damage by the reader/sorter foil.

Moreover, as indicated herein the processes of the present invention can be utilized for electrophotographic imaging systems including xerographic imaging and printing processes wherein the pressure fixing and/or pressure transfer is selected, and moreover the encapsulated toners are preferably utilized with carrier components, that is a two component developer composition, reference for example U.S. Pat. Nos. 4,560,635; 4,298,672 and 3,590,000, the disclosures of which are totally incorporated herein by reference.

Encapsulated toners and imaging processes thereof are known, however, the prior art is apparently silent with regard to the selection of encapsulated toners for MICR processes. There are disclosed in U.S. Pat. No. 4,307,169 microcapsular electrostatic marking particles containing a pressure fixable core, and an encapsulating substance comprised of a pressure rupturable shell, which shell is formed by an interfacial polymerization. One shell prepared in accordance with the teachings of this patent is a polyamide obtained by interfacial polymerization. In the '169 patent, it is indicated that when magnetite or carbon black is selected they must be treated in a separate process to prevent migration thereof to the oil phase.

Interfacial polymerization processes are described in British Patent Publication 1,371,179, the disclosure of which is totally incorporated herein by reference, which publication illustrates a method of microencapsulation based on in situ interfacial condensation polymerization. More specifically, this publication discloses a process which permits the encapsulation of organic pesticides by the hydrolysis of polymethylene polyphenylisocyanate, or toluene diisocyanate monomers. Also, the wall forming reaction disclosed in the aforementioned publication is initiated by heating the mixture to an elevated temperature at which point the isocyanate monomers are hydrolyzed at the interface to form amines, which in turn react with unhydrolyzed isocyanate monomers to enable the formation of a polyurea microcapsule wall.

Moreover, there is disclosed in U.S. Pat. No. 4,407,922, the disclosure of which is totally incorporated herein by reference, interfacial polymerization processes for pressure sensitive toner compositions comprised of a blend of two immiscible polymers selected from the group consisting of certain polymers as a hard component, and polyoctadecylvinylether-co-maleic anhydride as a soft component.

In a patentability search report, there were listed the following U.S. Pat. Nos.: 4,517,268 relating to xerographic toners for MICR printing; 4,268,598 which discloses a magnetic toner for the printing of machine readable legends; 4,748,506 relating to magnetic encapsulated toners, see column 4, wherein there is mentioned, for example, Columbia Mapico Black, and Bayferrox magnetites; and 3,627,682; 4,439,510; 4,536,462 and 4,581,312, which patents disclose, for example, encapsulated toners with magnetites.

In a related patentability search report, there were listed the following U.S. Pat. Nos.: 4,016,099; 4,265,994; 4,497,885; 4,520,091; 4,590,142; 4,599,289 and 4,803,144.

Illustrated in U.S. Pat. No. 4,758,506, the disclosure of which is totally incorporated herein by reference, are single component development cold pressure fixable toner compositions, wherein the shell selected can be prepared by an interfacial polymerization process. Also known are single component magnetic cold pressure fixable toner compositions comprised of magnetite and a polyisobutylene encapsulated in a polymeric shell material generated by an interfacial polymerization process. More specifically, there are illustrated in the aforementioned copending application cold pressure fixable magnetic single component developers with carbon black and large amounts of magnetite.

Furthermore, prior art, primarily of background interest, includes U.S. Pat. Nos. 4,254,201; 4,465,755; and Japanese Patent Publication 58-100857. The Japanese publication discloses a capsule toner with high mechanical strength, which is comprised of a core material including a display recording material, a binder, and an outer shell, which outer shell is preferably comprised of a polyurea resin. In the '201 patent, there are disclosed encapsulated electrostatographic toners wherein the shell material comprises at least one resin selected from polyurethane resins, a polyurea resin, or a polyamide resin. In addition, the '755 patent discloses a pressure fixable toner comprising encapsulated particles containing a curing agent, and wherein the shell is comprised of a polyurethane, a polyurea, or a polythiourethane. Moreover, in the '201 patent there are illustrated pressure sensitive adhesive toners comprised of clustered encapsulated porous particles, which toners are prepared by spray drying an aqueous dispersion of the granules containing an encapsulated material.

Furthermore, there are illustrated in U.S. Pat. No. 4,280,833 encapsulated materials prepared by interfacial polymerization in aqueous herbicidal compositions containing these capsules. More specifically, as indicated in column 4, beginning at line 9, there is disclosed a process for encapsulating a water immiscible material within a shell of the polyurea, wherein polymethylene polymethyl polyphenyl isocyanate can be added to an aqueous phase with agitation to form a dispersion of small droplets of the water immiscible phase within the aqueous phase; and thereafter, a polyfunctional amine is added with continuous agitation to the organic aqueous dispersion, reference column 4, lines 15 to 27. Also of interest is the disclosure in column 5, line 50, wherein the amine selected can be diethylene triamine, and the core material can be any liquid, oil, meltable solid or solvent soluble material, reference column 4, line 30. A similar teaching is present in U.S. Pat. No. 4,417,916.

In U.S. Pat. No. 4,599,271 there are illustrated microcapsules obtained by mixing organic materials in water emulsions at reaction parameters that permit the emulsified organic droplets of each emulsion to collide with one another, reference the disclosure in column 4, lines 5 to 35. Examples of polymeric shells are illustrated, for example, in column 5, beginning at line 40, and include isocyanate compounds such as toluene diisocyanate, and polymethylene polyphenyl isocyanates. Further, in column 6, at line 54, it is indicated that the microcapsules disclosed are not limited to use on carbonless copying systems; rather, the film material could comprise other components including xerographic toners, see column 6, line 54.

Other prior art of interest includes U.S. Pat. No. 4,520,091, which illustrates an encapsulated toner material wherein the shell can be formed by reacting a compound having an isocyanate with a polyamine, reference column 4, lines 30 to 61, and column 5, line 19; and U.S. Pat. No. 3,900,669 illustrating a pressure sensitive recording sheet comprising a microcapsule with polyurea walls, and wherein polymethylene polyphenyl isocyanate can be reacted with a polyamine to produce the shell, see column 4, line 34.

Additionally, in U.S. Pat. No. 4,476,211 there is disclosed a process for the preparation of toner compositions which can be selected for cold pressure fixing processes, which compositions are provided with a colored electroconductive powder on the outer surface thereof, such powders including, for example, carbon black and colloidal graphite, which are spray dried together with the wet toner dispersion. Also, U.S. Pat. No. 3,196,032 and Dutch Patent Application 7203523 illustrate a process of rendering single component developer powders electroconductive by the deposition of fine carbon particles on the toner surfaces. Disadvantages associated with the aforementioned toners include the release of the carbon black particles from the surface resulting in a loss of conductivity stability, and also resulting in contamination and premature failure of the electrical systems of the electrophotographic imaging apparatus within which they are incorporated. Moreover, British Patent 940,577 and U.S. Pat. No. 4,286,037 illustrate the use of water soluble and water insoluble antistatic agents as electroconductive coating materials, however, high impractical loadings such as, for example, 8 to 35 percent by weight of ammonium salts are needed to obtain a resistivitiy of $10^7$ to $10^{11}$ ohm-cm, which adversely effects the particle size; flow and fusing properties of the toner particles, and has other disadvantages.

In U.S. Pat. No. 4,877,706, mentioned hereinbefore, the disclosure of which is totally incorporated herein by reference, there are illustrated single component pressure fixable toner compositions wherein a core component is encapsulated by certain polymeric shells, especially those comprised of polymers obtained from isocyanate substituted aromatic compounds. More specifically, in one embodiment of the '706 patent there are provided single component development cold pressure fixable toner compositions comprised of a polymeric core with magnetic pigment particles therein, such as magnetite, and an encapsulating polymeric shell prepared by interfacial polymerization. These encapsulated shells are obtained by the reaction of a first component comprised of polyisocyanates available from Dow Chemical Company, including for example PAPI 27, PAPI 135, PAPI 94, PAPI 901, Isonate 143L, Isonate 181, Isonate 125M, Isonate 191, and Isonate 240; and a second amine component selected, for example, from the group consisting of ethylenediamine, tetramethylenediamine, pentamethylenediamine, hexamethylenediamine, p-phenylenediamine, m-phenylenediamine, 2-hydroxy trimethylenediamine, diethylenetriamine, triethylenetetraamine, tetraethylenepentaamine, 1,8-diaminooctane, xylylene diamine, bis(hexamethylene) triamine, tris(2-aminoethyl)amine, 4,4'-methylene bis (cyclohexylamine), bis(3-aminopropyl)ethylene diamine, 1,3-bis(aminomethyl)cyclohexane, 1,5-diamino-2-methylpentane, piperazine, 2-methylpiperazine, 2,5-dimethylpiperazine, and 1,4-bis(3-aminopropyl)piperazine. Generally, the shell polymer comprises from about 6 to about 25 percent by weight of the total toner composition, and preferably comprises from about 12 percent by weight to about 18 percent by weight of the toner composition. During the aforementioned interfacial polymerization to form the shell, the temperature is maintained at from about 15° C. to about 55° C., and preferably from about 20° C. to about 30° C. Also, generally the reaction time is from about 1 minute to about 5 hours, and preferably for about 20 minutes to about 90 minutes.

In another embodiment, the aforementioned '706 patent discloses a cold pressure fixing toner composition comprised of a core containing a polymer component and magnetic pigment particles, which core is encapsulated within a shell comprised of the interfacial polycondensation reaction of a first polyisocyanate component and a second amine component, and wherein said toner includes thereon an electroconductive material obtained from a water based dispersion of said material in a polymeric binder, said first polyisocyanate component being selected from the group consisting of PAPI 27, PAPI 135, PAPI 94, PAPI 901, Isonate 143L, Isonate 181, Isonate 125M, Isonate 191, Isonate 240, toluene diisocyanate, hexamethylene diisocyanate, trimethyl hexamethylene diisocyanate, and isophorone diisocyanate; and said second amine component selected from the group consisting of ethylenediamine, tetramethylenediamine, pentamethylenediamine, hexamethylenediamine, p-phenylenediamine, m-phenylenediamine, 2-hydroxy trimethylenediamine, diethylenetriamine, triethylenetetraamine, tetraethylenepentaamine, 1,8-diaminooctane, xylylene diamine, bis (hexamethylene) triamine, tris (2-aminoethyl) amine, 4,4'-methylene bis (cyclohexylamine), bis (3-aminopropyl)ethylene diamine, 1,3-bis (aminomethyl) cyclohexane, 1,5-diamino-2-methylpentane; and piperazine, 2-methylpiperazine, 2,5-dimethylpiperazine, and 1,4-bis (3-aminopropyl) piperazine. Generally, the isocyanate is selected in an amount of about 5 percent by weight to about 20 percent by weight, and preferably in an amount of about 8 percent by weight to about 12 percent by weight. Moreover, the polyisocyanate can be comprised of a mixture containing compounds having at least two isocyanate groups with an average functionality of from about 2 to 4, and preferably from about 2.0 to about 2.6, which mixtures contain, for example, from about 0.1 percent by weight to about 11.9 percent by weight of a first polyisocyanate containing an average functionality of 2.6, and from about 0.1 percent by weight to about 11.9 percent by weight of a second polyisocyanate containing a functionality of 2.0. The encapsulated toners of the aforementioned patent are especially useful for the processes of the present invention.

Illustrated in U.S. Pat. No. 4,883,736, the disclosure of which is totally incorporated herein by reference, are toner compositions including magnetic single component, and colored toner compositions containing certain polymeric alcohol waxes. More specifically, there is disclosed in the patent the elimination of toner spots, or comets with developer compositions comprised of toner compositions containing resin particles, particularly styrene butadiene resins, pigment particles such as magnetites, carbon blacks or mixtures thereof; polymeric hydroxy waxes available from Petrolite, which waxes can be incorporated into the toner compositions as internal additives or may be present as external components; and optional charge enhancing additives, particularly, for example, distearyl dimethyl ammonium methyl sulfate, reference U.S. Pat. No. 4,560,635, the disclosure of which is totally incorporated herein by reference, and carrier particles.

In U.S. Pat. No. 4,517,268, mentioned hereinbefore, the disclosure of which is totally incorporated herein by reference, there is illustrated a process for generating documents such as personal checks suitable for magnetic image character recognition, which process involves generating documents in high speed electronic laser printing devices. The developer composition disclosed in this patent is comprised of, for example, magnetic particles, such as magnetite, certain styrene resin particles, and carrier particles as illustrated in the Abstract of the Disclosure. Additive particles may also be included in the developer compositions of this patent.

Although the above described processes are useful for their intended purposes, there is a need for improved processes. More specifically, there is a need for magnetic image character recognition (MICR) processes enabling the generation of documents, such as personal checks, with encapsulated toner and developer compositions wherein toner offsetting and image smearing is avoided. There is also a need for the generation of developed images including the generation of personal checks in laser printers or ionographic printers utilizing magnetic ink character recognition technology, wherein toner offset to protective foils present on the read and write heads is avoided or minimized, and image smearing is avoided or minimized. In addition, there is a need for MICR processes with encapsulated toners wherein toner offsetting to protective foils, and image smearing on documents generated is reduced or eliminated. Furthermore, there is a need for processes in which the distribution of magnetite in the MICR toner is very uniform. It is believed that in melt blended toners containing a high concentration of magnetite (60 weight percent, for example) that the distribution of magnetite is not very uniform. For example, some particles may have 50 weight percent magnetite while other particles have 70 weight percent of magnetite which leads to a lowering of the threshold voltage window over which development takes place and results in background on the prints. It has been demonstrated by scanning electron and transmission electron microscopy that with the processes of the present invention the encapsulated toners have both intra-particle and inter-particle magnetite distributions usually superior in uniformity to those achieveable through melt blending. Although it is not desired to be limited by theory, it is believed that the method by which the magnetite is dispersed, and with the present invention in one embodiment the magnetite can be dispersed in an organic phase using a polytron homogenizer at, for example, 8,000 rpm, while with conventional toners that are not encapsulated the toner components, for example resin particles, carbon black, magnetite, and the like are mixed in a melt blending process is advantageous as superior dispersions can result, for example. Apparently, with the polytron there can be provided in some embodiments superior magnetite dispersions, which are expected to result in a more uniform magnetic signal strength across the developed image, improved conformity to the standard wave form and therefore a lower rejection rate as indicated herein.

With the processes of the present invention, it is preferred that the encapsulated toners have high, for example, 50 to 70 weight percent of magnetite loadings, and thus relatively low remanence magnetites are selected to provide the desired magnetic signal strength in the MICR reader. The aforementioned magnetite iron oxides are more economical than the higher remanence magnetites which are selected for many MICR toners in which the loadings are substantially lower, for example 30 percent.

SUMMARY OF THE INVENTION

It is an object of the present invention to provide toner and developer compositions, processes for obtaining images thereof, and particularly processes for generating documents, such as personal checks, which are subsequently processed in reader/sorters with many of the advantages illustrated herein.

Another object of the present invention resides in the provision of processes for generating documents, such as personal checks, suitable for magnetic ink character recognition, which processes utilize encapsulated toner compositions.

In another object of the present invention there are provided processes for generating documents, such as personal checks, suitable for magnetic ink character recognition, which processes utilize encapsulated toner compositions wherein toner offsetting, and image smearing is avoided or minimized.

Moreover, another object of the present invention relates to processes wherein toner offsetting to the read and write heads, including those that are not protected, or those that contain a protective foil thereon, is avoided or minimized.

In another object of the present invention, there are provided processes for processing documents wherein offsetting and image smearing are avoided or minimized.

Also, in another object of the present invention there are provided processes wherein, for example, image smearing and toner offsetting is avoided when documents such as checks containing magnetic characters thereon are utilized in commercial sorters, and/or reader/sorters.

Additionally, in yet another object of the present invention there are provided magnetic ink character recognition processes (MICR), which processes are suitable for the generation of documents with encapsulated toner compositions, and wherein these checks can be utilized in commercial sorters, and/or reader/sorters such as the IBM 3890™ without toner offsetting and image smearing.

In another important object of the present invention there are provided processes for generating documents, such as personal checks, suitable for magnetic image character recognition, which processes utilize encapsulated toner compositions and wherein the characters present on the documents are fused with a pressure roll, and wherein these documents can be utilized in commercial sorters such as the IBM 3890™ and the NCR 6780™ without toner offsetting and image smearing as illustrated herein.

These and other objects of the present invention are accomplished by providing processes with developer compositions and toner compositions that are useful for generating documents inclusive of personal checks, which documents are subsequently processed in reader/sorter devices as illustrated herein. More specifically, the present invention is directed to processes for generating documents, which comprise the formation of images, such as latent images with a printing device especially devices generating from about 8 to about 135 prints per minute; developing the image with an encapsulated toner composition; subsequently transferring the developed image to a suitable substrate; permanently affixing the image thereto; and thereafter processing the documents in reader/sorters wherein image offsetting and image smearing are avoided or substantially reduced. Some examples of the aforementioned process wherein an encapsulated toner is not selected are illustrated in U.S. Pat. No. 4,517,268, especially column 3, the disclosure of which is totally incorporated herein. Examples of high speed ionographic printers, which can be utilized for the process of the present invention, include the Delphax S6000™ printers and the commercially available Xerox Corporation 4060™. Thereafter, the formed documents with magnetic characters thereon are processed in reader/sorter apparatuses as illustrated herein.

One specific embodiment of the present invention is directed to a process for obtaining images which comprises the generation of a latent image and developing the latent images with a toner composition comprised of a core comprised of a polymer, and pigment, such as magnetite, which core is encapsulated in a polymeric shell.

In an embodiment of the present invention, there is provided an ionographic process which comprises the generation of a latent image comprised of characters; developing the image with an encapsulated magnetic toner comprised of a core comprised of a polymer and magnetite with a coercivity of from about 80 to about 250 Oersteds, and a remanence of from about 20 to about 70 Gauss, and wherein the core is encapsulated within a polymeric shell; and subsequently providing the developed image with magnetic ink characters thereon to a reader/sorter device whereby toner offsetting and image smearing is minimized in said device. Also encompassed by the present invention are electrophotographic, especially xerographic, imaging and printing processes wherein the encapsulated toners disclosed herein are selected.

The encapsulated toner compositions selected for the process of the present invention in an embodiment are comprised of a core comprised of a polymer or a mixture of polymers, particularly nonbrittle polymers, with a glass transition temperature of from about −100° C. to about −10° C., and preferably from about −70° to about −25° C., and magnetites with a low remanent moment of from about 20 to 70 Gauss, and preferably from about 25 to 55 Gauss, and a coercivity of from about 80 to about 250 Oersteds, which core is encapsulated in a polymeric shell. In one embodiment of the present invention, there are selected for the process of the present invention toner compositions comprised of a core of methacrylates, methacrylate copolymers and preferably dodecyl methacrylate octadecyl methacrylate copolymers, and magnetite particles such as Bayferrox 8600 (remanence 34 Gauss), 8610 (remanence 55 Gauss); Northern Pigments 604 (remanence 27 Gauss), 608 (remanence 31 Gauss); Magnox 104 (remanence 27 Gauss), TMB-100 (remanence 25 Gauss); Columbian Mapico Black (remanence 34 Gauss); Pfizer CX6368 (remanence 26 Gauss), CB5600 (remanence 26 Gauss); and the like, which core is encapsulated in a polymeric shell of, for example, polyurea, polyester, the shells as illustrated in U.S. Pat. No. 4,877,706, the disclosure of which is totally incorporated herein by reference; and the like. The remanence was measured on a tapped powder magnetite sample in a cell of 1.0 centimeters×1.0 centimeter×about 4 centimeters. The sample is magnetized between two magnetic pole faces with a saturating magnetic field of 2,000 Gauss, such that the induced magnetic field is perpendicular to one of the 1×4 centimeter faces of the cell. The sample is removed from the saturating magnetic field, and the remanence is measured perpendicular to the above 1 centimeter wide face, using a Hall-Effect device or a gaussmeter, such as the F. W. Bell, Inc. Model 615 gaussmeter. Additionally, the toner compositions selected may include as additives, preferably external additives, in amounts, for example, of from about 0.1 to about 2.0 percent of colloidal silica such as Aerosil R972, metal salts, metal salts of fatty acids such as zinc stearate, and the like, reference U.S. Pat. Nos. 3,720,617; 3,900,588 and 3,590,000, the disclosures of which are totally incorporated herein by reference.

Illustrative specific examples of suitable core polymers present in various effective amounts such as, for example, from about 20 percent by weight to about 40 percent by weight, include pressure fixable adhesive materials possessing a low glass transition temperature of from about −170° C. to about +25° C., and preferably from −100° C. to −10° C. can be selected for the toners of the present invention. The core polymer can be obtained by the in situ free-radical polymerization of a core monomer or monomers up to, for example, 10, including acrylates and methacrylates, such as butyl acrylate, propyl acrylate, benzyl acrylate, pentyl acrylate, hexyl acrylate, cyclohexyl acrylate, dodecyl acrylate, ethoxy propyl acrylate, heptyl acrylate, isobutyl acrylate, methyl butyl acrylate, 2-ethoxyethyl acrylate, 2-butoxyethyl acrylate, 2-ethylbutyl acrylate, 2-ethylhexyl acrylate, 2-methoxypropyl acrylate, nonyl acrylate, octyl acrylate, m-tolyl acrylate, dodecyl methacrylate, hexyl methacrylate, isodecyl methacrylate, 2-ethoxyethyl methacrylate, octyl methacrylate, decyl methacrylate, tetradecyl methacrylate, octadecyl methacrylate, styrene, dodecyl styrene, hexyl methyl styrene, nonyl styrene, tetradecyl styrene, or other known vinyl monomers, reference for example U.S. Pat. No. 4,298,672, the disclosure of which is totally incorporated herein by reference, mixtures thereof; and the like. The core monomer is polymerized to obtain a polymer with, for example, a number average molecular weight ($M_n$) of from about 15,000 to about 100,000, and preferably from about 25,000 to about 60,000; and a ratio ($M_w/M_n$) of weight average molecular weight/number average molecular weight of greater than 2, and preferably from about 2.5 to about 4.0. Preferred core monomers, which are subsequently polymerized, include dodecyl methacrylate, octadecyl methacrylate, styrene, n-butyl acrylate and mixtures thereof.

Illustrative examples of free-radical polymerization initiators selected for formation of the core polymer include azo compounds or mixtures thereof such as 2,2'-azobisisobutyronitrile (Vazo 64), 2,2'-azobis(2,4-dimethylvaleronitrile) (Vazo 52), and other similar known compounds with the ratio of core monomer to initiator being from about 100/0.5 to about 100/7, and preferably from about 100/1 to about 100/4, at a polymerization temperature and reaction time of from about 50° C. to about 90° C. at about 2 hours to about 6 hours, respectively.

Examples of magnetites selected for the toner and developer compositions utilized for the process of the present invention include those illustrated herein such as Mapico Black, which magnetites are generally present in the toner composition in an amount of from about 45 percent by weight to about 70 percent by weight, and preferably in an amount of from about 50 percent by weight to about 65 percent by weight.

Preferred are magnetites with a coercivity of from about 80 to about 160 Oersteds and a low remanent magnetic moment of from about 25 to about 55 Gauss. An illustrative process for the preparation of the encapsulated toner particles of the present invention is described in U.S. Pat. No. 4,727,011, the disclosure of which is totally incorporated herein by reference. One preparation process involves dispersion of a magnetic colorant with a polytron homogenizer in a mixture of hydrophobic liquids such as a polyisocyanate, a core monomer and an initiator; subsequent dispersion of the above pigmented organic medium in an aqueous medium containing a hydrophilic protective colloid thereby generating a stable particle suspension; adding a water soluble shell component to produce shells around the core material particles; and heating of the reaction mixture to polymerize the core monomer. Subsequently, the encapsulated toner is washed with water by decantation to remove unreacted water soluble shell component and protective colloid. The toner slurry is now suitable for a subsequent drying procedure. Toner compositions with a conductivity of $10^{-4}$ to $10^{-8}$ $ohm^{-1}$ $cm^{-1}$ for inductive development are prepared by spray drying, using a commercially available Yamato DL-41, the aforementioned toner slurry together with Aquadag E (Acheson Colloids Ltd.), a water based dispersion of conductive colloidal graphite (20 weight percent), containing a polymeric binder (2 weight percent). Spray drying can be accomplished in an air inlet temperature of 150° C. to yield an encapsulated toner as a free flowing powder with conductivity in the range of about $10^{-4}$ to about $10^{-8}$ $ohm^{-1}$ $cm^{-1}$. Depending on the particle size of the toner, about 1 to about 2 parts of colloidal graphite for 100 parts of the toner are selected to impart the desired conductivity. For example, a toner of particle size average diameter of 18 microns requires 1.2 parts of Aquadag E to 100 parts of the toner to impart a conductivity of $10^{-6}$ $ohm^{-1}$ $cm^{-1}$.

Usually the magnetite is dispersed in a mixture of the core monomer or momomers containing the initiators, and the hydrophobic shell component by means of a Brinkman polytron homogenizer. More specifically, homogenization is continued until a smooth, uniform dispersion is obtained; generally, 3 minutes at 8,000 revolutions per minute is sufficient in an embodiment of the present invention. Subsequent dispersion of the above pigmented organic medium in an aqueous medium containing, for example, poly(vinyl alcohol) as a protective colloid is accomplished with use of the same homogenizer for 2 minutes at 9,000 revolutions per minute. Both of the aforementioned dispersing procedures can be accomplished at room temperature.

Encapsulated shells are as illustrated, for example, in U.S. Pat. No. 4,877,706, which shells are obtained by the reaction of a first component comprised of polyisocyanates available from Dow Chemical Company, including for example PAPI 27, PAPI 135, PAPI 94, PAPI 901, Isonate 143L, Isonate 181, Isonate 125M, Isonate 191, and Isonate 240; and a second amine component selected, for example, from the group consisting of ethylenediamine, tetramethylenediamine, pentamethylenediamine, hexamethylenediamine, p-phenylenediamine, m-phenylenediamine, 2-hydroxy trimethylenediamine, diethylenetriamine, triethylenetetraamine, tetraethylenepentaamine, 1,8-diaminooctane, xylylene diamine, bis(hexamethylene)triamine, tris(2-aminoethyl) amine, 4,4'-methylene bis(cyclohexylamine), bis(3-aminopropyl)ethylene diamine, 1,3-bis(aminomethyl) cyclohexane, 1,5-diamino-2-methylpentane, piperazine, 2-methylpiperazine, 2,5-dimethylpiperazine, and 1,4-bis(3-aminopropyl)piperazine. Generally, the shell polymer comprises from about 6 to about 25 percent by weight of the total toner composition, and preferably comprises from about 12 percent by weight to about 18 percent by weight of the toner composition. During the aforementioned interfacial polymerization to form the shell, the temperature is maintained at from about 15° C. to about 55° C., and preferably from about 20° C. to about 30° C. Also, generally the reaction time is from about 1 minute to about 5 hours, and preferably for about 20 minutes to about 90 minutes. Other temperatures and times can be selected, and further polyisocyanates and amines not specifically illustrated may be selected. Specific examples of shells include those comprised of the interfacial polycondensation reaction of a first polyisocyanate component and a second amine component, and wherein said toner includes thereon an electroconductive material obtained from a water based dispersion of said material in a polymeric binder, said first polyisocyanate component being selected from the group consisting of PAPI 27, PAPI 135, PAPI 94, PAPI 901, Isonate 143L, Isonate 181, Isonate 125M, Isonate 191, and Isonate 240; and said second amine component selected from the group consisting of ethylenediamine, tetramethylenediamine, pentamethylenediamine, hexamethylenediamine, p-phenylenediamine, m-phenylenediamine, 2-hydroxy trimethylenediamine, diethylenetriamine, triethylenetetraamine, tetraethylenepentaamine, 1,8-diaminooctane, xylylene diamine, bis (hexamethylene) triamine, tris (2-aminoethyl) amine, 4,4'-methylene bis (cyclohexylamine), bis (3-aminopropyl)ethylene diamine, 1,3-bis (aminomethyl) cyclohexane, 1,5-diamino-2-methylpentane; and piperazine, 2-methylpiperazine, 2,5-dimethylpiperazine, and 1,4-bis (3-aminopropyl) piperazine. Generally, the isocyanate is selected in an amount of from about 5 percent by weight to about 20 percent by weight, and preferably in an amount of from about 8 percent by weight to about 12 percent by weight. Moreover, the polyisocyanate can be comprised of a mixture containing compounds having at least two isocyanate groups with an average functionality of from about 2 to about 4, and preferably from about 2.0 to about 2.6, which mixtures contain, for example, from about 0.1 percent by weight to about 11.9 percent by weight of a first polyisocyanate containing an average functionality of 2.6, and from about 0.1 percent by weight to about 11.9 percent by weight of a second polyisocyanate containing a functionality of 2.0.

Other isocyanates, provided the objectives of the present invention are achieved, may perhaps be selected for reaction with the amine to enable formation of the shell by interfacial polymerization, reference for example U.S. Pat. No. 4,612,272, and U.K. Patents 2,107,670 and 2,135,469, the disclosures of which are totally incorporated herein by reference.

Specific illustrative examples of known available isocyanates that can be selected include (1) polymethylene polyphenyl isocyanates (Dow Chemical Company); PAPI 27, PAPI 135, PAPI 94, PAPI 901; (2) diphenylmethane diisocyanates (Dow Chemical Company); Isonate 143L, Isonate 181, Isonate 125M, Isonate 191, Isonate 240; and (3) toluene diisocyanate and Desmodur RF (20 percent tris(p-isocyanato-phenyl)-thiophosphate in methylene chloride); commercially available from Mobay Chemical Corporation. PAPI is believed to be a mixture of pure diphenylmethane diisocyanate (MDI) and higher molecular weight MDI oligomers. The weight average molecular weight is from about 260 to about 300 for PAPI 94 and PAPI 901, and from about 340 to about 380 for PAPI 27 and PAPI 135, while the average functionality is 2.3 for PAPI 94 and PAPI 901, and 2.6 for PAPI 27 and PAPI 135. Isonate 125M is pure MDI which is crystalline at room temperature. The other aforementioned isonates are liquid at room temperature, containing a mixture of pure MDI and its adducts.

Specific illustrative examples of water soluble amine compounds, which are capable of polymerizing interfacially with the above-mentioned isocyanate compounds to form a durable capsule shell, include:

(1) polyamines—ethylenediamine, tetramethylenediamine, pentamethylenediamine, hexamethylenediamine, p-phenylenediamine, m-phenylenediamine, 2-hydroxy trimethylenediamine, diethylenetriamine, triethylenetetraamine, tetraethylenepentaamine, 1,8-diaminooctane, xylylene diamine, bis(hexamethylene)triamine, tris(2-aminoethyl) amine, 4,4'-methylene bis(cyclohexylamine), bis(3-aminopropyl)ethylene diamine, 1,3-bis(aminomethyl) cyclohexane, 1,5-diamino-2-methylpentane;

(2) piperazines—piperazine, 2-methylpiperazine, 2,5-dimethylpiperazine, 1,4-bis(3-aminopropyl)piperazine; and the like.

As a preferred shell material, there is selected the interfacial polycondensation product of Isonate 143L and 1,4-bis(3-aminopropyl)piperazine in the molar ratios of from about 1:1 to about 1:1.2, and preferably from about 1:1.03 to about 1:1.1; and PAPI 94 and 1,4-bis(3-aminopropyl) piperazine in the molar ratios of from about 1:1 to about 1:1.3, and preferably from about 1:1.1 to about 1:1.2.

The toner compositions of the present invention can be selected for the inductive development of electrostatic images. More specifically, in accordance with the present invention, there is provided a method for developing electrostatic images which comprises forming latent electrostatic images on a hard dielectric surface, such as silicon carbide, reference U.S. Pat. No. 4,877,706, the disclosure of which is totally incorporated herein by reference, by depositing thereon ions from a corona source; developing the images with the single component magnetic toner composition illustrated herein; followed by simultaneous transferring and fixing by cold pressure onto paper with a toner transfer efficiency in some instances of greater than 95 percent, and in many instances from 99 to 99.5 percent as determined by, for example, weighing the amount of toner recovered by the cleaning blade. The cold pressure fixing rollers selected generate pressures of from about 80 pounds per lineal inch to about 250 pounds per lineal inch, and preferably from about 100 pounds per lineal inch to about 150 pounds per lineal inch. Examples of cold pressure fixing processes and systems that can be selected include those commercially available, such as the Delphax S6000™, Hitachi and Cybernet.

Also, the present invention is directed to methods for the development of images by, for example, forming by ion deposition on an electroreceptor, such as a polymer impregnated anodized aluminum oxide, a latent image; developing this image with the cold pressure fixing encapsulated toner compositions of the present invention; and subsequently simultaneously transferring and fixing the image to a suitable substrate such as paper.

The following examples are being submitted to further define various species of the present invention. These examples are intended to illustrate and not limit the scope of the present invention. Also, parts and percentages are by weight unless otherwise indicated. The remanence was measured on a tapped powder magnetite sample in a cell of 1.0 centimeter×1.0 centimeter×about 4 centimeters. The sample is magnetized between two magnetic pole faces with a saturating magnetic field of 2,000 Gauss, such that the induced magnetic field is perpendicular to one of the 1 centimeter faces of the cell. The sample is removed from the saturating magnetic field, and the remanence is measured perpendicular to the above 1 centimeter wide face using a Hall-Effect device or a gaussmeter, such as the F. W. Bell, Inc. Model 615 gaussmeter. Coercivities were obtained from the manufacturer and were also measured on tapped powder samples using a vibrating sample magnetometer. Particle sizes were determined on both wet and spray dried toner samples using a Coulter Counter Model ZM, available from Coulter Electronics, Inc. Conductivities were measured on powdered samples, which were packed in a 1 $cm^3$ cell using a horseshoe magnet placed beneath the cell. Two opposite walls of the cell are 1 centimeter×1 centimeter conductive metal plates. The other walls and the bottom of the cell are 1 centimeter×1 centimeter, and are comprised of an insulating material. A voltage of 10 volts is applied across the plates, and the current flow through the plates is measured using an electrometer. The conductivity is the ratio of the current over the voltage, and is measured in $ohm^{-1}$ $cm^{-1}$. In the Delphax S6000™ ionographic printer, electronically encoded check documents were imaged ionographically on the dielectric cylinder, the resultant latent images were developed, and then were fused under pressure rollers at 100 pounds per lineal inch, which resulted in personal check documents with magnetic characters thereon. The magnetic characters were generated in accordance with the E13-B font, the standard as defined by the American National Standards Institute (ANSI). The magnetic signals from the documents were tested using the MICR-MATE I check reader obtained from Checkmate Electronics, Inc. The ANSI standards for MICR documents are 50 to 200 percent nominal magnetic signal in an E13-B font with the preferred range of about 120 to about 150 percent nominal for the MICR "On-Us" character. Tests simulating image offset, such as occurs in the IBM 3890™ reader/sorter, which contains a protective foil on the read and write heads, were evaluated by applying a reproducible standard pressure between a protective foil and a printed image at speeds equivalent to reader/sorter operating at 2,500 checks/minute. Toner offset to the protective foil, as occurs in the IBM 3890™ reader/sorter, was measured either visually, or as mass of toner offset to the foil.

EXAMPLE I

There was prepared an encapsulated single component development cold pressure fixable toner composition by adding to a two liter reaction vessel, followed by homogenization with a Brinkman Polytron (Model PT 45/80) at room temperature for 1 minute at 4,000 revolutions per minute (rpm), 66.7 grams of dodecyl methacrylate (Rocryl 320, available from Rohm and Haas), 66.7 grams of octadecyl methacrylate (Scientific Polymer Products), 47.1 grams of liquid diphenylmethane diisocyanate (Isonate 143L, available from Dow Chemical), 20 milliliters of dichloromethane, 1.67 grams of 2,2'-azobisisobutyronitrile initiator (Vazo 64, available from E. I. duPont de Nemours & Company), and 1.67 grams of 2,2'-azobis(2,4-dimethylvaleronitrile) initiator (Vazo 52, available from E. I. duPont de Nemours & Company). Into the mixture was dispersed 280 grams of magnetic iron oxide with a remanence of 31 Gauss; (NP-608, available from Northern Pigment) with a Polytron at room temperature for 3 minutes at 8,000 rpm to obtain a homogeneous magnetic pigment dispersion comprised of the aforementioned components.

Separately, an aqueous solution comprised of 1.5 grams of poly(vinyl alcohol) (88 percent hydrolyzed; MW 96,000; available from Scientific Polymer Products) in 1,000 grams of deionized water at 25° C. was prepared by stirring. The poly(vinyl alcohol) solution was then charged into the above two liter reaction vessel. Thereafter, the above prepared magnetic pigment dispersion was dispersed into the prepared aqueous phase for 2 minutes by means of the Polytron at 9,000 rpm. There was obtained an oil-in-water suspension comprised of the aforementioned components, and containing pigmented oily spherical particles with an average particle diameter of 18 microns.

The resulting suspension was agitated under low speed stirring (about 300 rpm), and 37 milliliters of 1,4-bis (3-aminopropyl) piperazine (Aldrich Chemical) and 80 milliliters of water was added to the reaction vessel to initiate the formation of the polyurea shell. Stirring at room temperature was continued for 90 minutes to permit completion of the polyurea shell formation by interfacial polymerization. Subsequently, to affect polymerization of the above core monomers the temperature was gradually raised to and maintained at 85° C. for 5 hours at which time polymerization of the core monomers was complete. The reaction vessel was cooled to 25° C. and any unreacted 1,4-bis (3-aminopropyl) piperazine and residual poly(vinyl alcohol) were removed from the slurry by elutriation. Subsequently, the toner slurry was sieved through a 60 mesh screen to remove coarse particles. There resulted an encapsulated toner comprised of a dodecyl methacrylate octadecyl methacrylate core copolymer, 28 weight percent, containing 56 weight percent NP-608 magnetite therein surrounded by a shell comprised of the polycondensation product of Isonate 143L and 1,4-bis (3-aminopropyl) piperazine, 16 weight percent.

To the resulting slurry, containing 395 grams of the above mentioned toner, was added 200 milliliters of deionized water and 22.9 grams of Aquadag E, containing about 20 percent by weight of graphite, and grafted on the graphite surface about 2 percent by weight of polymeric binder; the aforementioned grafted Aquadag is commercially available from Acheson Colloids Ltd. The resulting encapsulated toner with the aforementioned composition and 1.16 parts of graphite per 100 parts toner had an average particle diameter of 18 microns and a conductivity of $2.5\times10^{-6}$ $ohm^{-1}$ $cm^{-1}$.

One hundred parts of the above-mentioned dry toner material was then blended with 1.5 parts of zinc stearate (release agent). The toner was then sieved through a 230 mesh screen to remove agglomerated additives resulting in the aforementioned encapsulated toner with 1.5 parts of zinc stearate on its surface.

The magnetic signal for the MICR "On-Us" character from personal check documents was tested using the MICR-MATE I check reader, and provided a value of 124 percent of nominal.

There can be included as external toner additives as illustrated in Example I metal salts or metal salts of fatty acids such as zinc stearate and the like in an amount of from about 0.1 to about 3 percent by weight, reference for example U.S. Pat. Nos. 3,590,000 and 3,983,045, the disclosures of each of these patents being totally incorporated herein by reference.

EXAMPLE II

An encapsulated toner was prepared by repeating the procedure of Example I with the following exceptions: 59.5 grams of dodecyl methacrylate, 59.5 grams of octadecyl methacrylate, 3.0 grams of 2,2'-azobisisobutyronitrile, 3.0 grams of 2,2'-azobis (2,4dimethylvaleronitrile), 290 grams of magnetic iron oxide (NP-608, available from Northern Pigment) and 20.1 grams of Aquadag E were selected. The resulting encapsulated toner was comprised of a dodecyl methacrylate octadecyl methacrylate core copolymer, 26 weight percent, containing 58 weight percent NP-608 magnetite therein, surrounded by a shell comprised of the polycondensation product of Isonate 143L and 1,4-bis (3-aminopropyl) piperazine, 16 weight percent, and this toner had an average particle diameter of 20 microns. The above mentioned encapsulated toner was spray dried with 1.1 parts of graphite per 100 parts of toner to provide a conductivity for the prepared encapsulated toner of $1.5\times10^{-6}$ $ohm^{-1}$ $cm^{-1}$.

The magnetic signal for the MICR "On-Us" character from personal check documents with the above prepared toner was tested using the MICR-MATE I check reader providing a value of 127 percent of nominal.

EXAMPLE III

An encapsulated toner was prepared by repeating the procedure of Example II with the exceptions that Northern Pigment NP-608 magnetite was replaced with Magnox TMB-100 magnetite, which has a coercivity of 92 Oersteds and a remanence of 25 Gauss. The resulting encapsulated toner was comprised of a dodecyl methacrylate octadecyl methacrylate copolymer, 26 weight percent, containing 58 weight percent Magnox TMB-100 magnetite therein surrounded by a shell comprised of the polycondensation product of Isonate 143L and 1,4-bis (3-aminopropyl) piperazine, 16 weight percent, and this toner had an average particle diameter of 20 microns. The above mentioned encapsulated toner was spray dried with 1.05 parts of graphite per 100 parts toner to provide a conductivity thereof of $6\times10^{-6}$ $ohm^{-1}$ $cm^{-1}$.

The magnetic signal for the MICR "On-Us" character from personal check documents with the above prepared toner was tested using the MICR-MATE I check reader giving a value of 123 percent of nominal.

EXAMPLE IV

An encapsulated toner was prepared by repeating the procedure of Example I with the exceptions that Northern Pigment NP-608 magnetite was replaced with Bayferrox 8610 magnetite, which has a coercivity of 150 Oersteds and a remanence of 55 Gauss, and 57.1 grams of dodecyl methacrylate, 57.1 grams of octadecyl methacrylate, 2.85 grams of 2,2'-azobisisobutyronitrile, and 2.85 grams of 2,2'-azobis (2,4-dimethylvaleronitrile), 300 grams of magnetic iron oxide (Bayferrox 8610) and 25.3 grams of Aquadag E were selected. The resulting encapsulated toner which was comprised of a dodecyl methacrylate octadecyl methacrylate copolymer, 24 weight percent, containing 60 weight percent Bayferrox 8610 magnetite therein, surrounded by a shell comprised of the polycondensation product of Isonate 143L and 1,4-bis (3-aminopropyl) piperazine, 16 weight percent, had an average particle diameter of 18 microns. The above mentioned encapsulated toner was spray dried with 1.27 parts of graphite per 100 parts toner to provide a conductivity thereof of $1\times10^{-6}$ $ohm^{-1}$ $cm^{-1}$.

The magnetic signal for the MICR "On-Us" character from personal check documents with the above prepared toner was tested using the MICR-MATE I check reader giving a value of 140 percent of nominal.

EXAMPLE V

An encapsulated toner was prepared by repeating the procedure of Example I with the exception that Northern Pigment NP-608 magnetite was replaced with Columbian Mapico Black magnetite, which has a coercivity of 95 Oersteds and remanence of 34 Gauss, and the weights of the some of the components were changed as follows: 71.4 grams of dodecyl methacrylate, 71.4 grams of octadecyl methacrylate, 1.79 grams of 2,2'-azobisisobutyronitrile, and 1.79 grams of 2,2'-azobis (2,4-dimethylvaleronitrile), 270 grams of magnetic iron oxide (NP-608, available from Northern Pigment) and 20.3 grams of Aquadag E. The resulting encapsulated toner which was comprised of a dodecyl methacrylate octadecyl methacrylate core copolymer, 30 weight percent, containing 54 weight percent Mapico Black magnetite therein, surrounded by a shell comprised of the polycondensation product of Isonate 143L and 1,4-bis (3-aminopropyl) piperazine, 16 weight percent, had an average particle diameter of 19 microns. The above mentioned encapsulated toner was spray dried with 1.2 parts of graphite per 100 parts toner to provide a conductivity of $7\times10^{-6}$ $ohm^{-1}$ $cm^{-1}$.

The magnetic signal for the MICR "On-Us" character from personal check documents with the above prepared toner was tested using the MICR-MATE I check reader providing a value of 140 percent of nominal.

EXAMPLE VI

An encapsulated toner was prepared by repeating the procedure of Example IV with the exceptions that the core monomer was comprised of 114.2 grams of dodecyl methacrylate and no octadecyl methacrylate. The resulting encapsulated toner which was comprised of a poly dodecyl methacrylate core, 24 weight percent, containing 60 weight percent Bayferrox 8610 magnetite therein surrounded by a shell comprised of the polycondensation product of Isonate 143L and 1,4-bis (3-aminopropyl) piperazine, 16 weight percent, had an average particle diameter of 16 microns. The above mentioned encapsulated toner was spray dried with 1.36 parts of graphite per 100 parts toner to provide a conductivity of $8\times10^{-6}$ $ohm^{-1}$ $cm^{-1}$.

The magnetic signal for the MICR "On-Us" character from personal check documents with the above prepared toner was tested using the MICR-MATE I check reader providing a value of 137 percent of nominal.

In tests simulating an IBM 3890™ reader/sorter which contains a protective foil on the read and write heads, the encapsulated toner compositions of the above Examples, especially Example I, evidenced no image offset to the protective foil after the equivalent of 5 to 20 passes of 800 checks. The image offset for these toners to the protective foil utilized in the IBM 3890™ is estimated by visual inspection to be less than 10 percent than from images made using toner images according, for example, to the processes as described in U.S. Pat. No. 4,517,268 which comprise conventional melt blended toner compositions. In view of this, it is expected that reduced reader/sorter maintenance will result due to the reduction or elimination of toner offset to protective foils. The reduction of toner offset and smear results in a reduced rejection rate with the above prepared encapsulated toners, that is the number of magnetic image characters that could not be read, for check documents on multiple passes through a reader/sorter was 0.3 percent and in some instances could be as low as 0.05 percent, it is believed, with the above prepared encapsulated toners. Similar results can be obtained with the above prepared encapsulated toners, a Delphax S6000™ ionographic printer, and wherein toner offsetting and image smearing were minimized or avoided.

Other modifications of the present invention may occur to those skilled in the art subsequent to a review of the present application. The aforementioned modifications, including equivalents thereof, are intended to be included within the scope of the present invention.

What is claimed is:

1. A process which comprises generating character images in a magnetic image character recognition device, developing the images with an encapsulated magnetic ink comprised of a core comprised of a polymer and magnetite and wherein the core is encapsulated within a polymeric shell; transferring the images to a substrate; fusing the images thereto; and subsequently processing the substrate with magnetic ink characters thereon in a reader/sorter device.

2. A magnetic image character recognition process which comprises the generation of a latent image comprised of characters in a magnetic image character recognition device; developing the image with an encapsulated magnetic toner comprised of a core comprised of a polymer and magnetite with a coercivity of from about 80 to about 250 Oersteds, and a remanence of from about 20 to about 70 Gauss, and wherein the core is encapsulated within a polymeric shell; transferring the image to a substrate; fusing the image thereto and subsequently processing the developed fuse image with magnetic ink characters thereon in a reader/sorter device whereby toner offsetting and image smearing is minimized in said device.

3. A magnetic image character recognition process which comprises the generation of a latent image comprised of characters in an ion printing magnetic image character recognition apparatus; thereafter developing the image with an encapsulated magnetic toner comprised of a core comprised of a polymer and magnetite with a coercivity of from about 80 to about 160 Oersteds, and a remanence of from about 25 to about 55 Gauss, and wherein the core is encapsulated within a polymeric shell; transferring the image to a substrate; fusing the image thereto and subsequently processing the developed fused image with magnetic ink characters thereon in a reader/sorter device whereby toner offsetting and image smearing is minimized in said device.

4. A process in accordance with claim 1 wherein the toner composition contains the magnetite particles in an amount of from about 40 to about 80 percent by weight.

5. A process in accordance with claim 3 wherein the toner composition contains the magnetite particles in an amount of from about 50 to about 65 percent by weight.

6. A process in accordance with claim 1 wherein the core polymer possesses a glass transition temperature of from about −100° C. to about −10° C.

7. A process in accordance with claim 1 wherein the core polymer is selected from the group consisting of polymethacrylic acid esters, polyacrylic acid esters, acrylate methacrylate copolymers, styrene acrylate copolymers, and styrene methacrylate copolymers.

8. A process in accordance with claim 1 wherein the core polymer is dodecyl methacrylate octadecyl methacrylate containing about 50 percent by weight of dodecyl methacrylate, and about 50 percent by weight of octadecyl methacrylate.

9. A process in accordance with claim 1 wherein the magnetite is cubic or spherical in shape.

10. A process in accordance with claim 9 wherein image smearing and image offsetting to the read and write heads in the reader/sorter device is substantially avoided.

11. A process in accordance with claim 9 wherein image smearing and image offsetting to a protective foil present on the read and write heads in the reader/sorter device is avoided.

12. A process in accordance with claim 1 wherein toner offsetting is avoided after the documents generated are passed through a magnetic ink character recognition sorter.

13. A process in accordance with claim 1 wherein the magnetite is a ferromagnetic black iron oxide with the chemical formula $Fe_3O_4$.

14. A process in accordance with claim 11 wherein the magnetite particle shape is cubic or spheroidal.

15. A process in accordance with claim 1 wherein the polymeric shell is prepared by interfacial polymerization methods.

16. A process in accordance with claim 1 wherein the polymeric shell is comprised of the interfacial polycondensation reaction of a first polyisocyanate component and a second amine component, said first polyisocyanate component being selected from the group consisting of polymethylene polyphenylene isocyanates, diphenylmethane diisocyanates, toluene diisocyanate, hexamethylene diisocyanate, trimethyl hexamethylene diisocyanate, and isophorone diisocyanate; and said second amine component selected from the group consisting of ethylenediamine, tetramethylenediamine, pentamethylenediamine, hexamethylenediamine, p-phenylenediamine, m-phenylenediamine, 2-hydroxy trimethylenediamine, diethylenetriamine, triethylenetetraamine, tetraethylenepentaamine, 1,8-diaminooctane, xylylene diamine, bis (hexamethylene) triamine, tris (2-aminoethyl) amine, 4,4'-methylene bis (cyclohexylamine), bis (3-aminopropyl) ethylene diamine, 1,3-bis (aminomethyl) cyclohexane, 1,5-diamino-2-methylpentane, piperazine, 2-methylpiperazine, 2,5-dimethylpiperazine, and 1,4-bis (3-aminopropyl) piperazine.

17. A process in accordance with claim 1 wherein the core polymer component is selected from the group consisting of poly(dodecyl methacrylate), poly(dodecyl acrylate), poly (stearyl methacrylate), styrene-dodecyl methacrylate copolymer, and poly(dodecyl styrene).

18. A process in accordance with claim 1 wherein the core polymer is poly(dodecyl methacrylate); and a first shell monomer of a liquid diphenylmethane diisocyanate is reacted with a second shell amine monomer of 1,4-bis(3-aminopropyl)piperazine to form a partially crosslinked polyurea polymer shell.

19. A process in accordance with claim 1 wherein the core polymer is poly(dodecyl methacrylate); and a first shell monomer is reacted with a polymethylene polyphenyl isocyanate, which reacts with a second amine shell monomer of 1,4-bis(3-aminopropyl)piperazine to form a partially crosslinked polyurea polymer shell.

20. A process in accordance with claim 1 wherein the toner contains an electroconductive material.

21. A process in accordance with claim 1 wherein the toner contains external additives selected from the group consisting of metal salts of fatty acids, metal salts, colloidal silicas, or mixtures thereof.

22. A process in accordance with claim 1 wherein the conductivity of the toner is from about $10^{-4}$ to about $10^{-8}$ $ohm^{-1}$ $cm^{-1}$.

23. A process in accordance with claim 1 wherein the coercivity is from about 100 to about 150 Oersteds.

24. A process in accordance with claim 1 wherein the remanence is from about 25 to about 55 Gauss.

25. A process in accordance with claim 1 wherein the magnetic saturation of the magnetite is from about 72 to about 86 emu/gram.

26. A process in accordance with claim 1 wherein the read/write heads are free of toner deposits after the documents generated are passed through a magnetic ink character recognition sorter.

27. A magnetic image character recognition process which comprises the generation on a substrate of a latent image comprised of characters; developing the image with an encapsulated magnetic toner comprised of a core comprised of a polymer and magnetite with a coercivity of from about 80 to about 250 Oersteds, and a remanence of from about 25 to about 55 Gauss; and wherein the core is encapsulated within a polymeric shell; fixing the image on the substrate and subsequently processing the developed fixed image with magnetic ink characters thereon in a reader/sorter device whereby toner offsetting and image smearing is minimized in said device.

28. A magnetic image character recognition process which comprises generating on a substrate latent images comprised of characters with high or low speed electronic printing devices; thereafter developing the image with encapsulated magnetic toners comprised of a core comprised of a polymer and magnetite with a coercivity of from about 80 to about 160 Oersteds, and a remanence of from about 25 to about 55 Gauss, and wherein the core is encapsulated within a polymeric shell which includes thereon an electroconductive material fixing the image on the substrate; and subsequently processing the documents with magnetic ink characters thereon in a reader/sorter device whereby toner offsetting and image smearing is substantially avoided.

29. A magnetic image character recognition process which comprises the generation of a latent image comprised of characters in a magnetic character recognition device; developing the image with an encapsulated magnetic toner comprised of a core comprised of a polymer and magnetite with a coercivity of from about 80 to about 250 Oersteds, and a remanence of from about 20 to about 70 Gauss, and wherein the core is encapsulated within a polymeric shell; transferring the image to a substrate; fixing the image thereto and subsequently processing the fixed developed image with magnetic ink characters thereon in a reader/sorter device.

30. A process for generating personal checks which comprises providing a supporting substrate; forming image characters thereon in an ionographic or electrophotographic apparatus; developing the image with the encapsulated toner of claim 1; transferring the developed image to the substrate and fixing the image thereto and subsequently processing the substrate with magnetic ink characters thereon in a reader/sorter device.

31. A process in accordance with claim 2 wherein the magnetite coercivity is from about 25 to about 55 Gauss and there is selected a nonbrittle polymer with a glass transition temperature of from about −100° C. to about −10° C.

32. A process in accordance with claim 3 wherein the magnetite coercivity is from about 25 to about 55 Gauss and there is selected a nonbrittle polymer with a glass transition temperature of from about −100° C. to about −10° C.

33. A process in accordance with claim 2 wherein the magnetite is dispersed in the polymer.

34. A process in accordance with claim 2 wherein the encapsulated toner includes external toner additives.

35. A process in accordance with claim 3 wherein the encapsulated toner includes external toner additives.

36. A process in accordance with claim 2 wherein the encapsulated toner includes external toner additives.

37. A process in accordance with claim 36 wherein the external additives are metal salts of fatty acids.

38. A process in accordance with claim 37 wherein the metal salt of fatty acid is zinc stearate.

39. A process in accordance with claim 37 wherein the metal salt of fatty acid is present in an amount of about 0.1 to about 3 weight percent.

* * * * *